US007261211B2

(12) United States Patent
Robins

(10) Patent No.: US 7,261,211 B2
(45) Date of Patent: Aug. 28, 2007

(54) AIR TOOL STORAGE DEVICE

(76) Inventor: Terry Robins, Box 77, Minneapolis, KS (US) 67467

( * ) Notice: Subject to any disclaimer, the term of this patent is extended or adjusted under 35 U.S.C. 154(b) by 0 days.

(21) Appl. No.: 11/338,298

(22) Filed: Jan. 24, 2006

(65) Prior Publication Data

US 2006/0226096 A1 Oct. 12, 2006

Related U.S. Application Data

(60) Provisional application No. 60/647,761, filed on Jan. 31, 2005.

(51) Int. Cl.
*A47F 7/00* (2006.01)

(52) U.S. Cl. ..... 211/70.6

(58) Field of Classification Search ..... 211/70.6, 211/70, 78, 163, 196, 107, 205, 1.3, 133.4; 248/188.7, 188, 519, 415, 418, 186.2, 289.11, 248/291.11; 403/1, 14
See application file for complete search history.

(56) References Cited

U.S. PATENT DOCUMENTS

| | | | | |
|---|---|---|---|---|
| 723,114 | A * | 3/1903 | Witt | 211/205 |
| 3,310,180 | A * | 3/1967 | Neagle | 211/205 |
| 3,424,313 | A * | 1/1969 | Feibelman | 211/85.2 |
| 6,206,493 | B1 * | 3/2001 | Sanchez-Levin et al. | 312/125 |
| 6,241,105 | B1 * | 6/2001 | Pomper | 211/85.2 |
| 6,386,491 | B1 * | 5/2002 | Bissett | 248/121 |
| 6,505,749 | B1 * | 1/2003 | Panetta et al. | 211/86.01 |

* cited by examiner

*Primary Examiner*—Jennifer E. Novosad
(74) *Attorney, Agent, or Firm*—Banner & Witcoff, Ltd.

(57) ABSTRACT

An air tool storage device includes a mounting plate with axial shaft projecting therethrough for receipt of opposed flanged circular retainer members that are spaced apart so as to receive at one radial position an air tool disconnect plug. A body member within the space between the opposed circular retainer members may be rotated to align outwardly extending radial pins with the notches of the retainer members aligned so that disconnect plugs may be positioned on the device or removed from the device.

8 Claims, 3 Drawing Sheets

AIR TOOL STORAGE DEVICE

CROSS REFERENCE TO RELATED APPLICATION

This is a utility application based upon and incorporating by reference previously filed provisional application Ser. No. 60/647,761 filed Jan. 31, 2005 entitled "Air Tool Storage Device".

BACKGROUND OF THE INVENTION

In a principal aspect the present invention relates to a device for storing multiple air tools such as chucks, blow guns, connectors and the like.

Air chucks, blow guns and other air tools are produced in a large quantity having many styles and sizes. Although these devices vary in style and size, there are some common factors. That is, almost all include a ¼ inch female pipe thread into which most users install one or two common styles of disconnect plugs. "Style T" disconnect plug is known as an automotive design and "Style I-M" disconnect plug is an industrial design. The I-M plug design has been adopted by most coupler manufacturers.

Many tradesmen, craftsmen, auto mechanics, mechanics in general and other workers often require access to multiple air tools. Thus, there has developed a need for a device or storage arrangement which will enable ease of access to those tools while at the same time providing a means for storage which is secure and yet which may be portable.

SUMMARY OF THE INVENTION

Briefly, the present invention comprises an air tool holder or air tool storage device capable of holding multiple air tool elements or styles of air tools wherein the elements include an end fitting or disconnect plug with a central air passage, an outer, generally circular flange adjacent an inwardly positioned groove. FIGS. 1 and 2 of the present application illustrate in cross sectional profile the types of disconnect plugs that are used for most air tools as discussed in the Background.

The tool holder of the present invention is comprised of a mounting plate with an elongate support shaft extending from the plate. In a preferred embodiment, the mounting plate includes a magnet to attach the tool storage device or tool holder to a surface, for example, to a toolbox, a frame, a steel bench, or any other magnetic surface.

A first generally circular retainer member is non-rotatably mounted on the shaft and spaced from the mounting plate. The first generally circular retainer member is paired with a second generally circular retainer plate having a substantially similar configuration, shape and further including a flange which extends toward the first plate or retainer member. The opposed retainer members are spaced from one another a distance which is slightly greater than the diameter dimension of the groove of the disconnect plug and less than the diameter of a flange adjacent that groove. Notches in the outer edge of the opposed circular retainer members are provided which define a passage having a dimension greater than the diameter of the flange of the disconnect plug. A body member is located within the interior of the tool support device between the circular retainer members with radially projecting pins capable of receiving and holding the disconnect plug of air tool elements thereon. Thus, the body member may be rotated to a position which will enable placement of an air tool disconnect plug thereon and then subsequently rotated to expose a further pin upon which a second air tool disconnect plug may be positioned. The body member is thus rotational and is typically frictionally positioned between the plate or retainer members. A spring force may be utilized to compress the component parts in a manner which maintains the retainer members generally non-rotatable whereas the body member is rotatable.

In a preferred embodiment of the invention, six or more air tool elements may be stored upon the air tool storage device.

Thus, it is an object of the present invention to provide an air tool storage device which is capable of holding and retaining more than a single air tool.

It is a further object of the invention to provide an air tool storage device which may be attached magnetically to a support for ease of access to the air tools stored by the device.

It is another object of the invention to provide a magnetic air tool storage device which is capable of storing multiple tools and further capable of removal of single tools from the device.

Another object of the invention is to provide an air tool holder or air tool storage device which is rugged, reasonably priced, easy to use and which has a capability of storing multiple tools.

These and other objects, advantages and features of the invention will be set forth in the detailed description as follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
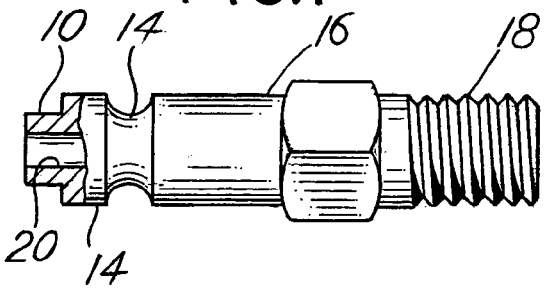
FIGS. 1 and 2 comprise profile or cross sectional views of typical disconnect plugs associated with air tools commonly found in industry.
Figure 2:
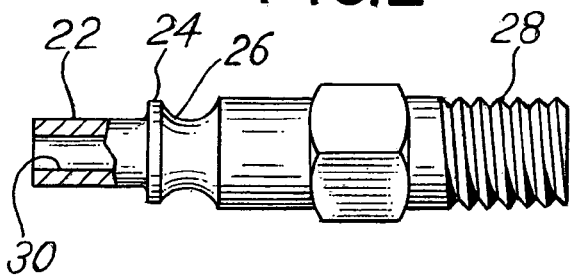

FIGS. 1 and 2 comprise profile or cross sectional views of the disconnect plugs associated with air tools. FIG. 1 is the so-called Style T and includes a pilot section 10, an adjacent circular flange 12, a locking groove 14, and a body 16. The opposite end of the disconnect plug is threaded for insertion into a tool and includes a threaded section 18. A central through passage 20 is provided for the T-Style disconnect plug.

FIG. 2 illustrates a second type or I-M style of disconnect plug. In this style, a pilot section 22 is elongated relative to the T-Style pilot section. A circular flange 24 is provided adjacent a groove 26. A threaded end 28 is provided for connection to an air tool. A through passage 30 is provided for air flow. The disconnect plugs are associated with various types of air tools such as blow guns and the like. The air storage device of the present invention is designed to be cooperative with both types of disconnect plugs as illustrated in FIGS. 1 and 2.

Figure 3:
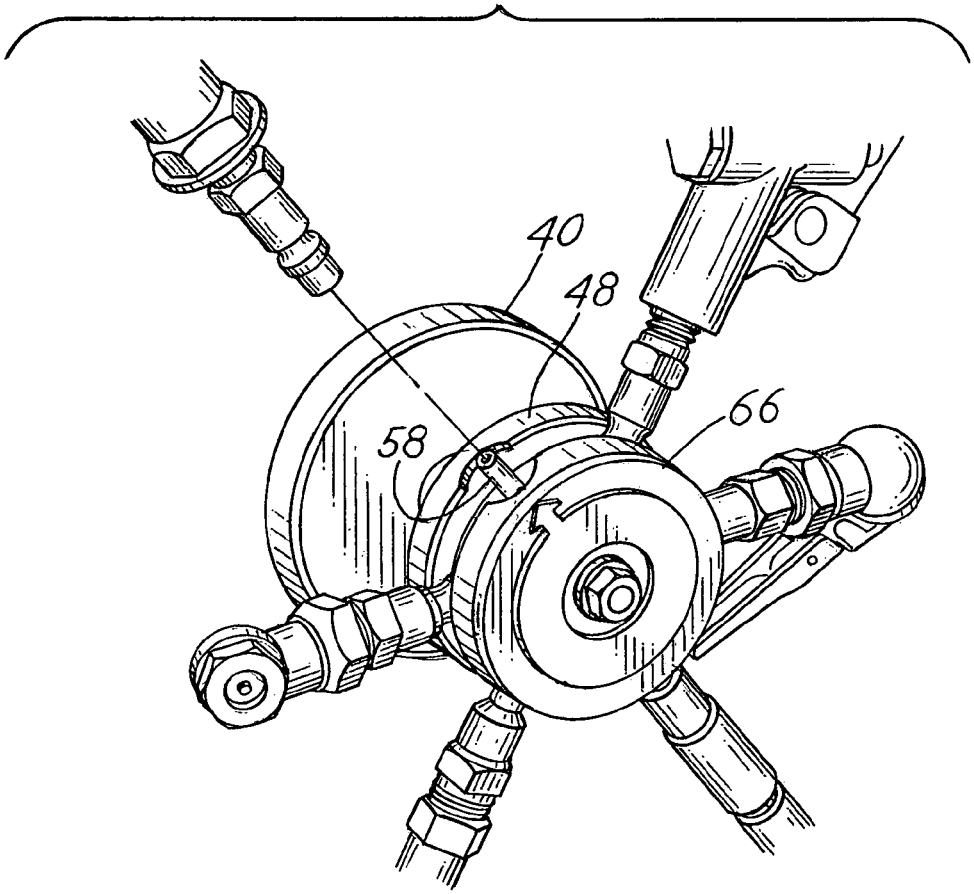
FIG. 3 is an isometric view of the improved air tool storage device of the present invention.
Figure 4:
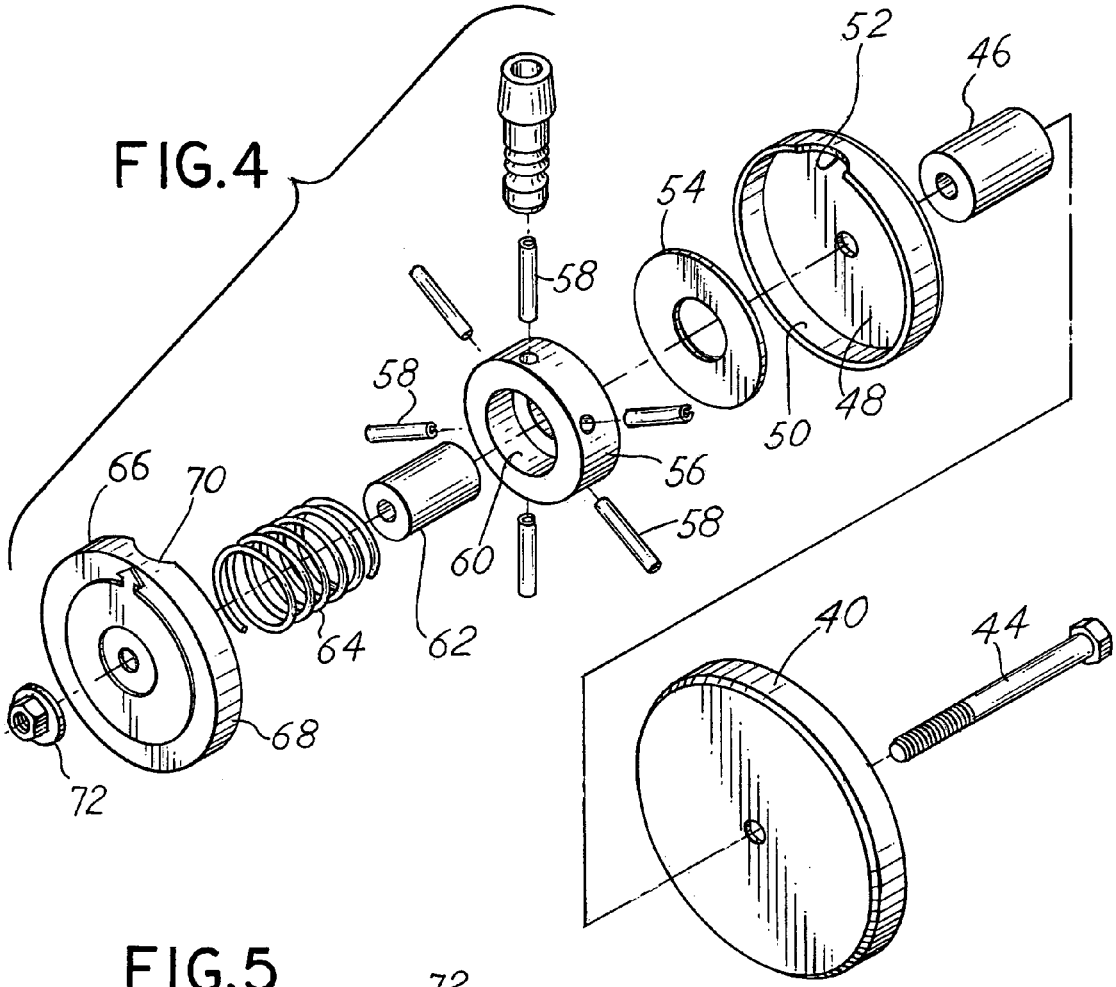
FIG. 4 is an exploded isometric view of a first embodiment of the air tool storage device or air tool holder of the invention.
Figure 5:
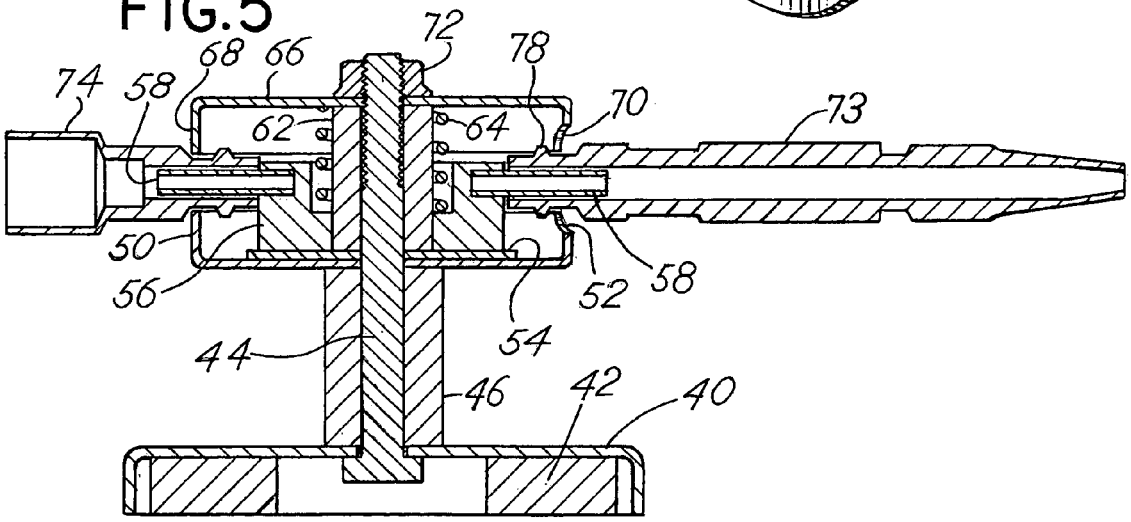
FIG. 5 is a cross sectional view of the embodiment of the invention depicted in FIG. 4.

FIGS. 3, 4 and 5 illustrate a first embodiment of the invention. Referring to those figures, the air tool storage device includes a mounting plate 40 which is generally circular and has a magnet 42 inserted on the inside or within the plate 40. An axially extending shaft or support shaft 44 comprises a threaded bolt which extends through the center opening in the plate 40. A spacer 46 receives the shaft 44. A flanged generally circular plate 48 having a generally circumferential peripheral outwardly extending flange 50 and with a notch 52 therein also receives the shaft 44. A disk 54 in the form of a washer is fitted against the circular retainer member 50. Disk 54 is preferably a nylon material which is fashioned with a frictional surface on the side facing the member 50 and a smooth, generally non-frictional or less frictional opposite side surface. The circular body member 56 having radially extending pins 58 equally spaced and extending radially outward therefrom includes a recess counterbore 60 that receives a second spacer 62. Spacer 62 is frictionally fitted against the inside face of a second retainer member 66 and is constructed to be less frictionally engaged against the inside of counterbore 60. A coil spring 64 fits about the spacer 62. A second retainer member 66 includes an inwardly extending flange 68 which is circumferential and peripheral and constitutes a substantial mirror image of the first retainer member 50. The second retainer member 66 includes a notch 70 which is arranged in opposition to the notch 52. A nut 72 is used to assemble the component parts into the form as depicted in FIG. 3.

FIG. 5 is a cross sectional view illustrating the assembly of the component parts described with two examples of disconnect plugs attached thereto. Thus, a first disconnect plug 73 fits on a pin 58 and a second disconnect plug 74 fits on a separate pin 58. The first disconnect plug 73 includes a circumferential or circular flange 78 which is sized so that it can slide through the opposed notches 52 and 70 of the opposed plates 50 and 66. However, the peripheral flange 50 of the first retainer member 48 in combination with the peripheral flange 68 of the second retainer member 66 provide an opening or slot therebetween which fits within the groove associated with the disconnect plug 74. Thus, it is necessary to align a pin 58 with the opposed notches 52 and 70 in order to insert or remove a disconnect plug and the particular air tool incorporated therewith. The spring and the disk brake or plate 54 insure that the component parts are adequately compressed so that the first and second retainer members are appropriately aligned and retained without rotation by virtue of frictional forces whereas the body member 56 may be rotated with respect thereto. Other alternative designs may be adapted to retain the plates 50, 66 in the desired position while permitting rotation of body member 56.

Figure 6:
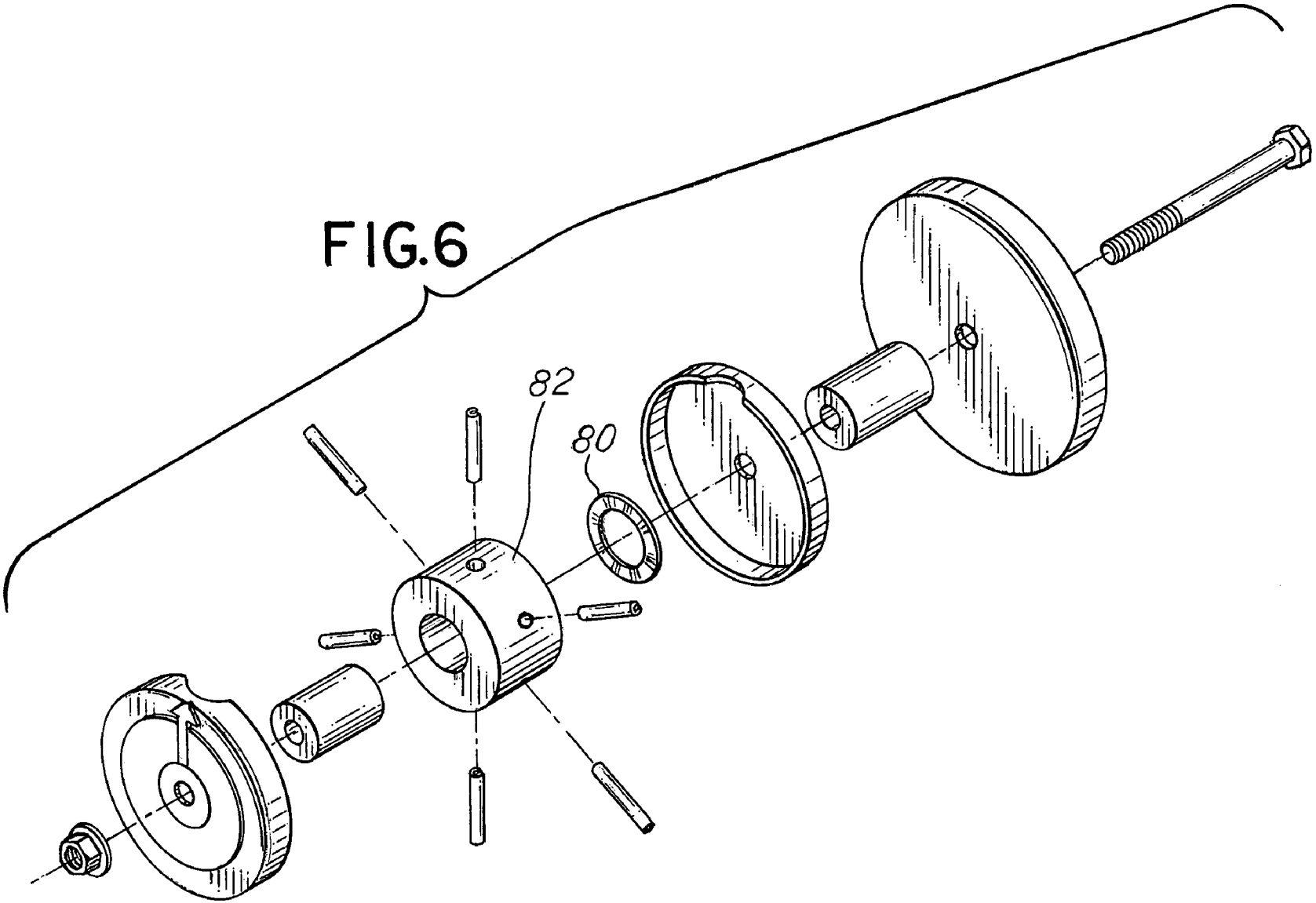
FIG. 6 is an alternative embodiment of the air tool storage device of the invention.

FIG. 6 discloses a second embodiment of the invention. In the embodiment of FIG. 6 the component parts are substantially the same except for the substitution of a Bellville spring 80 in place of the coil spring. A body member 82 also has a different configuration inasmuch as there is no spacer counterbore in the body member 82. Rather, the spacer fits entirely through the body member 82 and the Bellville spring 80. Otherwise, the component parts are the same and the method of operation is substantially the same.

In the embodiments depicted, there are six pins 58 which are arranged spaced at equal radial distances about the associated body member 56. Various alternatives may be incorporated including a different number of pins. The device is designed to hold at least two air tools and in any event. The inclusion of a single notch in the flange of the retainer members may be adjusted as may the position axially of the pins 58. That is, the notch may be incorporated in the flange of only one of the retainer members and the pins 58 move axially in accord therewith. Various other changes may be made without departing from the spirit and scope of the invention. The invention is therefore to be limited only by the following claims and equivalents thereof.

What is claimed is:

1. An air tool holder capable of holding multiple air tool elements, said elements including an end fitting with an air passage, an outer, generally circular flange adjacent an inwardly positioned groove, said tool holder comprising, in combination:

a mounting plate;

an elongate support shaft extending from the plate;

a first generally circular, non-rotatable retainer member mounted on the shaft and spaced from the plate, said first retainer member including a circumferential generally peripheral first flange at a first radial distance from the support shaft and extending axially outwardly away from the direction of the mounting plate;

a second generally circular retainer member mounted on the shaft in opposed relation to the first retainer member and including a generally circumferential, peripheral second flange extending axially toward the first flange of the first retainer, said second flange radially spaced from said support shaft a second radial distance substantially equal to the first radial distance, said first and second flanges in opposed relation and spaced from one another whereby said air tool element can be retained by positioning the first and second flanges in a groove thereof, at least one of the first and second flanges having a notch whereby the tool element may be disengaged from retention by the first and second flanges;

an air tool element mounting body member mounted on said support shaft intermediate the first and second retainer members, and at least two radially extending mounting pins on said body member, each pin extending radially from said shaft.

2. The holder of claim 1 wherein each retainer member is non-rotatably mounted on the shaft.

3. The holder of claim 1 wherein said first and second flanges each include a single notch and said notches are aligned in opposition to provide a slot.

4. The holder of claim 1 wherein the mounting plate includes a magnet.

5. The holder of claim 1 wherein the body member is rotationally mounted on the shaft and including means for frictionally retarding rotation of the body member on the shaft.

6. The holder of claim 1 wherein said first and second retainer members are non-rotatably mounted on the shaft, and each said flange includes a single notch, said notches aligned in opposed relation to provide a slot.

7. The holder of claim 1 further including a compressing spring on the shaft intermediate one of said retainer members and the body member.

8. The holder of claim 1 further including a spacer on the shaft intermediate the body member and one of said retainer members.

* * * * *